US011619219B2

(12) United States Patent
Schoenmeyr et al.

(10) Patent No.: US 11,619,219 B2
(45) Date of Patent: Apr. 4, 2023

(54) MULTI-CHAMBER WOBBLE PLATE PUMP WITH ASYMMETRIC INLET VALVE

(71) Applicant: Aquatec Water Systems, Inc., Irvine, CA (US)

(72) Inventors: Ivar L. Schoenmeyr, San Juan Capistrano, CA (US); Sedat Delareyna, Santa Ana, CA (US)

(73) Assignee: Aquatec International, Inc., Irvine, CA (US)

( * ) Notice: Subject to any disclaimer, the term of this patent is extended or adjusted under 35 U.S.C. 154(b) by 78 days.

(21) Appl. No.: 17/386,238

(22) Filed: Jul. 27, 2021

(65) Prior Publication Data

US 2021/0355928 A1 Nov. 18, 2021

Related U.S. Application Data

(63) Continuation of application No. 17/308,792, filed on May 5, 2021, which is a continuation-in-part of application No. 15/815,507, filed on Nov. 16, 2017, now Pat. No. 11,002,257.

(51) Int. Cl.

| | |
|---|---|
| ***F04B 43/02*** | (2006.01) |
| ***F04B 43/00*** | (2006.01) |
| ***F04B 43/04*** | (2006.01) |
| ***F04B 53/10*** | (2006.01) |

(52) U.S. Cl.

CPC ..... *F04B 43/026* (2013.01); *F04B 43/0054* (2013.01); *F04B 43/04* (2013.01); *F04B 53/1065* (2013.01)

(58) Field of Classification Search

CPC .... F04B 43/026; F04B 43/0054; F04B 53/02; F04B 53/1037; F04B 53/1047; F04B 53/105; F04B 53/1065; F16K 15/14; F16K 15/144; F16K 15/148; F16K 15/1481; F16K 15/16

See application file for complete search history.

(56) References Cited

U.S. PATENT DOCUMENTS

| | | | |
|---|---|---|---|
| 3,418,942 | A | 12/1968 | Partos |
| 4,781,540 | A | 11/1988 | Ikeda et al. |
| 5,067,449 | A | 11/1991 | Bonde |

(Continued)

OTHER PUBLICATIONS

International Search Report and the Written Opinion of PCT/US2017/065633 filed Dec. 11, 2017.

*Primary Examiner* — Kenneth J Hansen

(74) *Attorney, Agent, or Firm* — Irell and Manella LLP

(57) ABSTRACT

A multi-chamber wobble plate pump having a housing with an inlet port, an outlet port and a plurality of pump chambers. A wobble plate is coupled to a diaphragm and a plurality of pistons. Rotation of the wobble plate moves the pistons within the pump chambers to draw in and force fluid out of the chambers. The pump includes a plurality of inlet valves each located within one of the pump chambers to control fluid flow from the inlet port to the pump chambers. Each inlet valve has an asymmetric cross-section, a thin section and a stem along a longitudinal axis. The thin section of the valve has less mechanical strength than the remaining portion of the valve. The valve is configured to open first at the thin section from reduced pressure during outward movement of the piston allowing air to be removed from the chambers.

8 Claims, 4 Drawing Sheets

(56) References Cited

U.S. PATENT DOCUMENTS

| | | | | |
|---|---|---|---|---|
| 5,791,882 | A * | 8/1998 | Stucker | F04B 43/0045 417/269 |
| 6,604,909 | B2 * | 8/2003 | Schoenmeyr | F04B 43/04 417/32 |
| 2003/0099548 | A1 * | 5/2003 | Meza | F04B 43/0054 417/44.1 |
| 2003/0209138 | A1 | 11/2003 | Schoenmeyr et al. | |
| 2008/0003120 | A1 | 1/2008 | Meza et al. | |
| 2009/0136366 | A1 | 5/2009 | Taguchi | |
| 2010/0129234 | A1 | 5/2010 | Cai et al. | |
| 2011/0028853 | A1 | 2/2011 | Sano et al. | |
| 2013/0136637 | A1 | 5/2013 | Chang et al. | |

* cited by examiner

FIG. 1
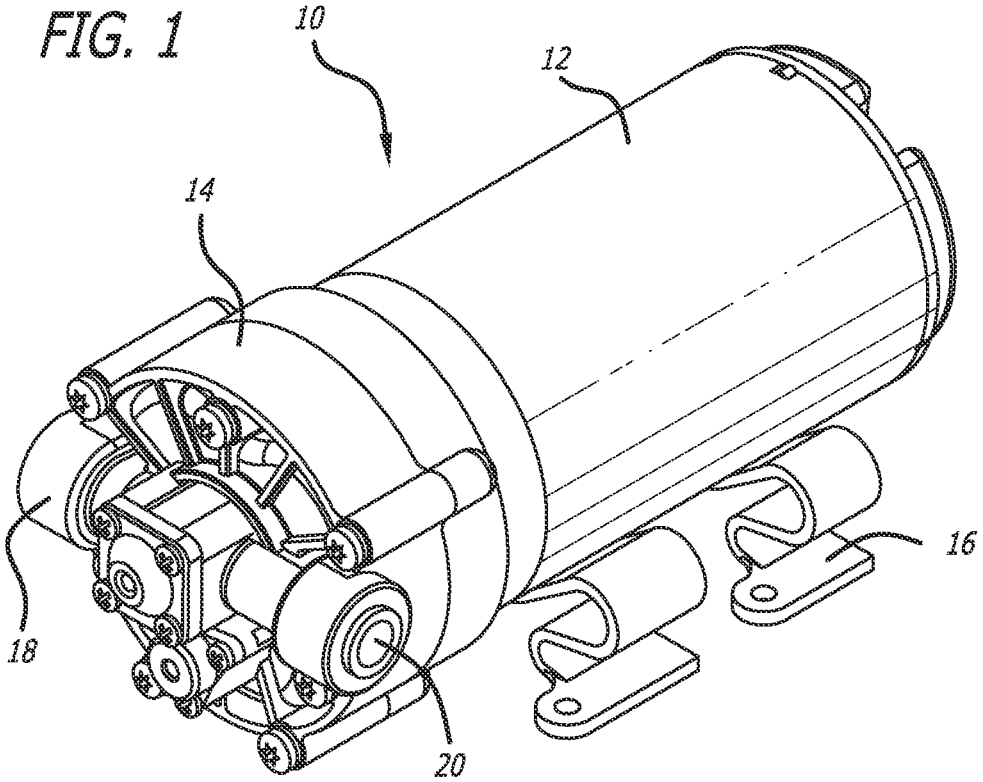
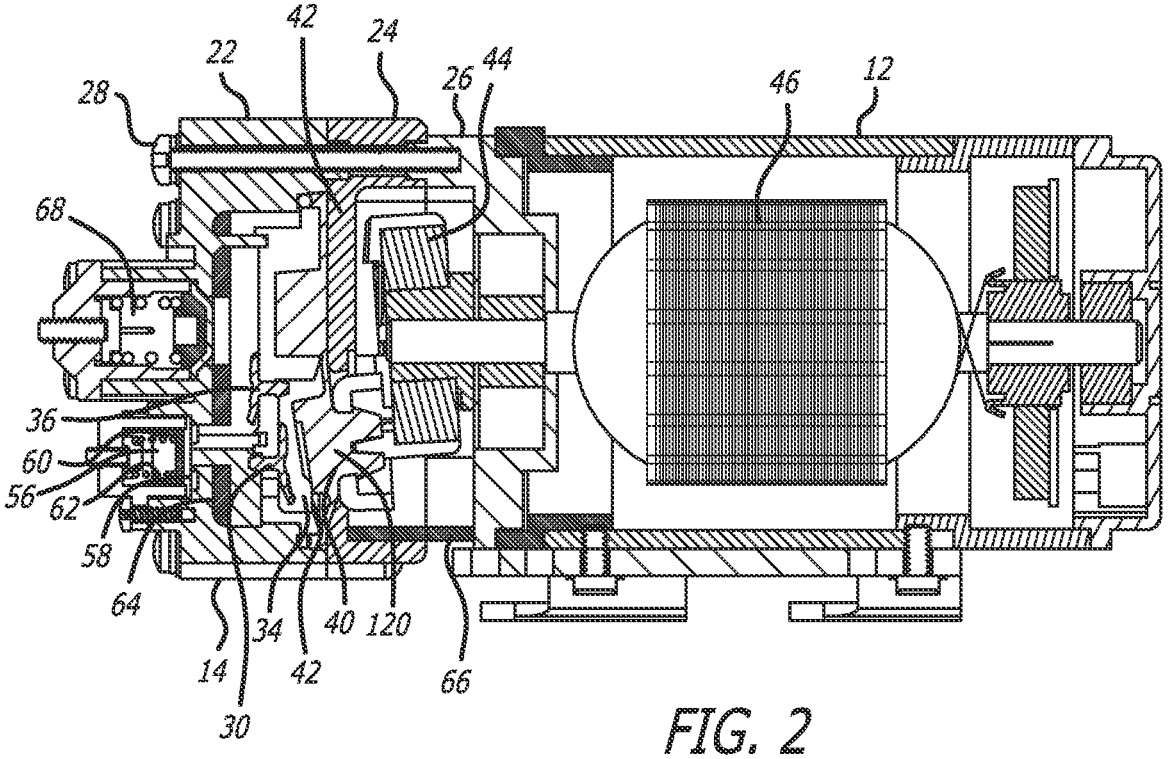
FIG. 2

MULTI-CHAMBER WOBBLE PLATE PUMP WITH ASYMMETRIC INLET VALVE

RELATED APPLICATION INFORMATION

This application is a continuation of U.S. application Ser. No. 17/308,792, filed May 5, 2021, which claims the priority benefit of U.S. application Ser. No. 15/815,507, filed on Nov. 16, 2017. The foregoing applications are hereby incorporated by reference as if set forth fully herein.

BACKGROUND OF THE INVENTION

Field of the Invention

The inventions relate to a diaphragm for a multi-chamber wobble plate pump.

Background Information

Multi-chamber wobble plate pumps are commonly used in various commercial applications such as RO systems, vehicles, beverage dispensers, water purification systems, laboratory and medical devices, floor cleaning products, road maintenance and solar applications. It is desirable to provide a pump that is reliable and minimizes both leaks and noise. Multi-chamber pumps are susceptible to air and/or particle entrapment within the pump chambers. This may occur when the pump is initially primed and there is air and particles within the pump chambers. The existence of particles and entrapped air may reduce the pump efficiency. It is therefore desirable to provide a pump that will reduce the occurrence of air and particle entrapment.

Multi-chamber wobble plate pumps operate in a cycle of pulling fluid into a pump chamber and then pushing the fluid out of the chamber. The cycles for pump chambers are out of phase so that there is a continuous flow of fluid. There is typically an overlap between the outflow of fluid from two of the pump chambers. This overlap creates pressure surges. The pressure surges create noise and generate stress that reduces the life of the pump. It is desirable to have a pump that reduces the noise and mechanical stress created by the pressure surges.

Wobble plate pumps are positive displacement pumps. If the outlet is blocked extreme pressures may be generated that can damage the pump and associated plumbing. It is therefore desirable to have a pump with an integrated relief valve.

Wobble plate pumps include a flexible diaphragm that is attached to a plurality of pump pistons and a wobble plate. Rotation of the wobble plate causes the pump pistons to move within the pump chambers in a manner that pulls in fluid and then pushes the fluid out of the chambers. The diaphragm is susceptible to wear and leakage. It is desirable to contain such leakage to within the pump, particularly when the pump is used in a consumer setting such as an RO system located in a user's home.

Some appliances, such as carbonators and water purifiers require higher water pressure to operate than what is available from tap water. Wobble plate diaphragm pumps may be used to boost the water pressure to the required level. However generating high pressure will put stress on the diaphragm of the pump and may cause diaphragm deformation. Such deformation may cause the diaphragm to rub against the drive mechanism that results in wear and shortens the diaphragm life. Thickening the flexible area will increase the diaphragm life but creates an additional load requirement on the motor driving the pump. In carbonators and water purifiers it is desirable to have a pump that is as small as possible. The flexible area of the diaphragm experiences different stress cycles during the pressure cycle depending on the location of the flex-area relative to the direction of motor rotation and resultant motion of the wobble plate. For example, the 'leading edge' of the flex area, (defined as the section that initiates the upwards movement of the pump piston) experiences a stress cycle that starts at low pressure and ends at high pressure. The 'trailing edge' on the other end of the flex area is subject to continuous high pressure and may have more overall stress than the leading edge. Additionally, during the pressure cycle, the torque on the diaphragm tends to stretch the leading arc, and compress the trailing arc of the flex area. The compression causes a certain amount of bulging that can bring the flex area into contact with the pump piston. Repeated contact during this nutating motion causes wear and limits the flex life of the diaphragm.

Present multi-chamber pumps orient the pistons with the centers of the piston openings in the wobbler housing. However the torque of the motor tends to rotate the pistons off center towards the trailing edge of the diaphragm. When the pump operates at higher pressures, it is desirable to make the unsupported area of the diaphragm as small as possible to minimize extrusion of the flexible area of the diaphragm during the pressure cycle. However over time the torque acting upon the diaphragm rotates the center of the diaphragm towards the trailing edge which may lead to physical contact between the piston and the supporting wobbler housing that produces unwanted noise.

BRIEF SUMMARY OF THE INVENTION

A multi-chamber wobble plate pump that includes a housing with an inlet port, an outlet port and a plurality of pump chambers. The pump further includes a plurality of inlet valves each located within one of the pump chambers to control fluid flow from the inlet port to the pump chambers. The pump also includes a plurality of outlet valves that control fluid flow from the pump chambers to the outlet port. A wobble plate is coupled to a diaphragm and a plurality of pistons. Rotation of the wobble plate moves the pistons within the pump chambers to draw in and force fluid out of the chambers. The diaphragm has at least one flex area with a leading edge and a trailing edge. The trailing edge of the diaphragm is thicker than the leading edge. The diaphragm may also have a plurality of diaphragm piston openings each with a diaphragm piston opening centerline. The wobble plate may have a plurality of wobble plate piston openings, each wobble plate piston opening having a wobble plate piston open centerline that is offset from one of diaphragm piston opening centerlines.

BRIEF DESCRIPTION OF THE DRAWINGS

FIG. 1 is a perspective view of a multi-chamber wobble plate pump;

FIG. 2 is a side cross-sectional view of the multi-chamber wobble plate pump;

DETAILED DESCRIPTION

Figure 4:
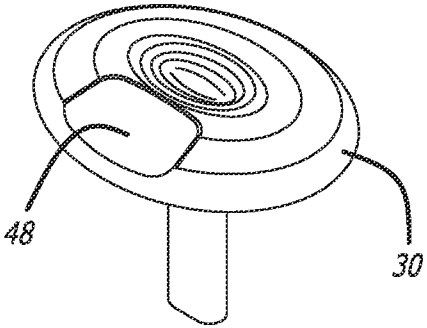
FIG. 4 is a perspective view of an inlet valve.

Disclosed is a multi-chamber wobble plate pump that includes a housing with an inlet port, an outlet port and a plurality of pump chambers. The pump further includes a plurality of inlet valves each located within one of the pump chambers to control fluid flow from the inlet port to the pump chambers. Each inlet valve may have an asymmetric cross-section with a thin section and/or a peripheral seal bead. The thin section is located away from an outlet port and opens before the remaining portion of the inlet valve opens to assist in the prevention of air entrapment in the pump chamber. The seal beads enhance the sealing action of the valves. The pump also includes a plurality of outlet valves that control fluid flow from the pump chambers to the outlet port and may each also have a peripheral seal bead. A wobble plate is coupled to a diaphragm and a plurality of pistons. Rotation of the wobble plate moves the pistons within the pump chambers to draw in and force fluid out of the chambers. The diaphragm may have a thin cross-sectional area that creates a hinge. The hinge increases the volume displacement within the pump chambers. The pump may further have a pulsation damper and a flexible liner located in-line with an outward flow of fluid and which absorb pressure transients and reduce noise. The pulsation dampener may be integrated into the relief valve. An elastomeric sleeve may be located adjacent to the wobble plate to provide both a seal and a noise absorber.

Referring to the drawings by reference numbers, FIG. 1 shows a multi-chamber wobble plate pump 10. The pump 10 includes an electric motor unit 12 connected to a pump housing 14. The pump 10 may have mounts 16 that can be mounted to a surface (not shown). The pump housing 14 includes an inlet port 18 and an outlet port 20.

Figure 3:
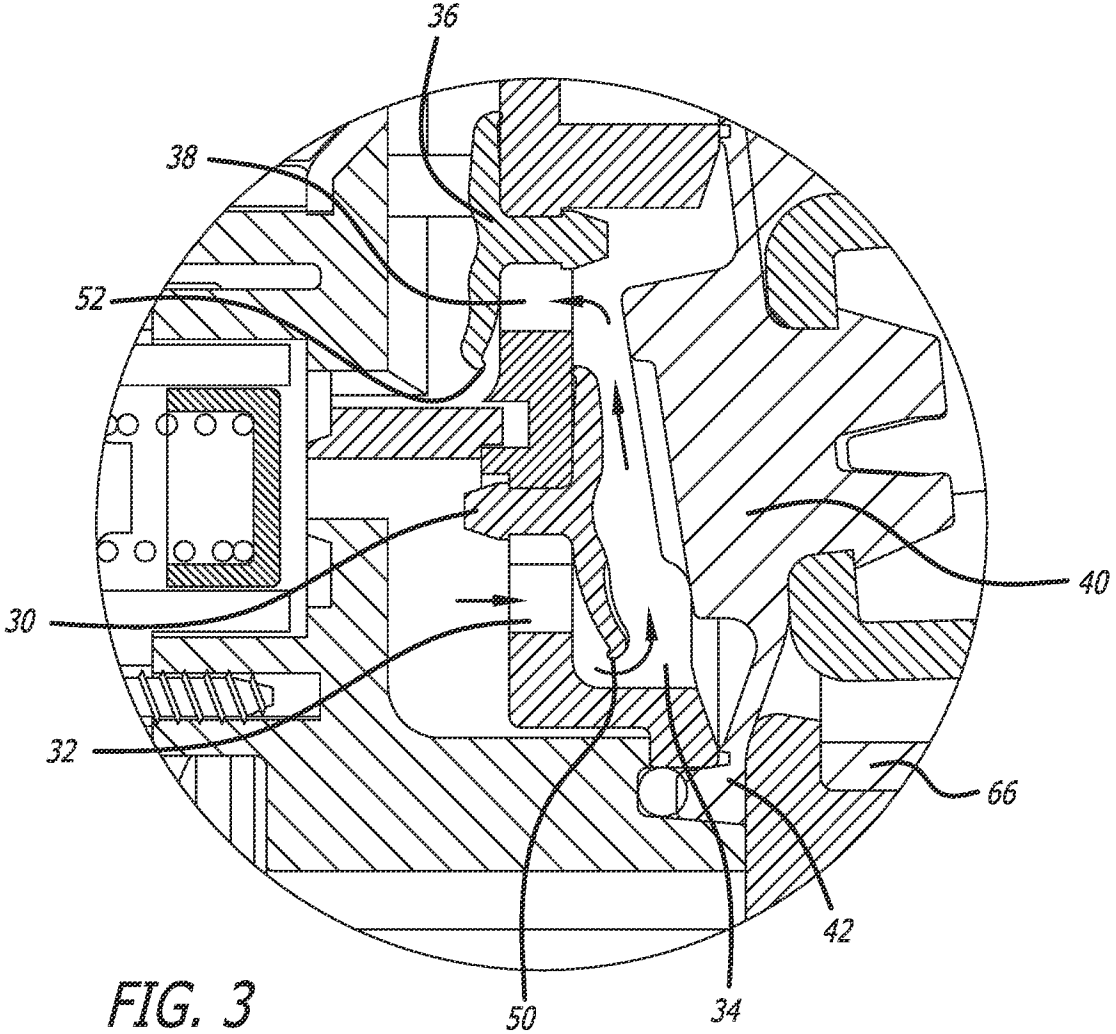
FIG. 3 is an enlarged cross-sectional view showing inlet and outlet valves of the pump.

Referring to FIGS. 2 and 3, the pump housing 14 can be constructed from three different pieces 22, 24 and 26 connected by screws 28. Within the housing 14 is an inlet valve 30 that controls the flow of fluid from an inlet opening 32 to a pump chamber 34. An outlet valve 36 controls the flow of fluid out of the pump chamber 34 and through an outlet opening 38. The inlet 32 and outlet 38 openings are in fluid communication with the inlet and outlet ports, respectively. Within the pump chamber 34 is a piston 40 that moves toward and away from the inlet 30 and outlet 36 valves. Outward movement creates a decrease in chamber pressure that causes the fluid from the inlet port 32 to push open the inlet valve 30 and flow into the pump chamber 34. Inward movement of the piston 40 increases the chamber pressure that causes the fluid to push open the outlet valve 36 and flow into the outlet port 38. The piston 40 is connected to a diaphragm 42 that seals the pump chamber 34. Although one inlet valve 30, outlet valve 36 and piston 40 are shown, it is to be understood that there are multiple pump chambers, valves and pistons that operate out of phase so that fluid is constantly being drawn in and pushed out of the chambers. By way of example, the pump 10 may have three pump chambers and corresponding ports and pistons. The diaphragm 42 is coupled to a wobble plate 44 that is connected to an electric motor 46. The motor 46 rotates the wobble plate 44 and causes the pistons 40 to move inward and outward as described above.

As shown in FIG. 4, each inlet valve 30 may have an asymmetric cross-section with a thin section 48. When the pressure in the chamber is reduced by the outward movement of the piston the thin section 48 will open first because that section has less mechanical strength then the remaining portion of the valve 30. As shown in FIG. 3, the thin section 48 is located at a lower level of elevation away from the outlet opening 38. Having a thin section 48 that opens at a low elevation located away from the outlet opening provides a system that will remove air within the pump chamber 34. Fluid will enter the lower area of the pump chamber 34 and push the air upward to the outlet opening 38. The inlet valve 30 may have a seal bead 50 that provides a uniform seal around the periphery of the valve 30. The outlet valve 36 may also have a seal bead 52 around the periphery of the valve 36.

Figure 5:
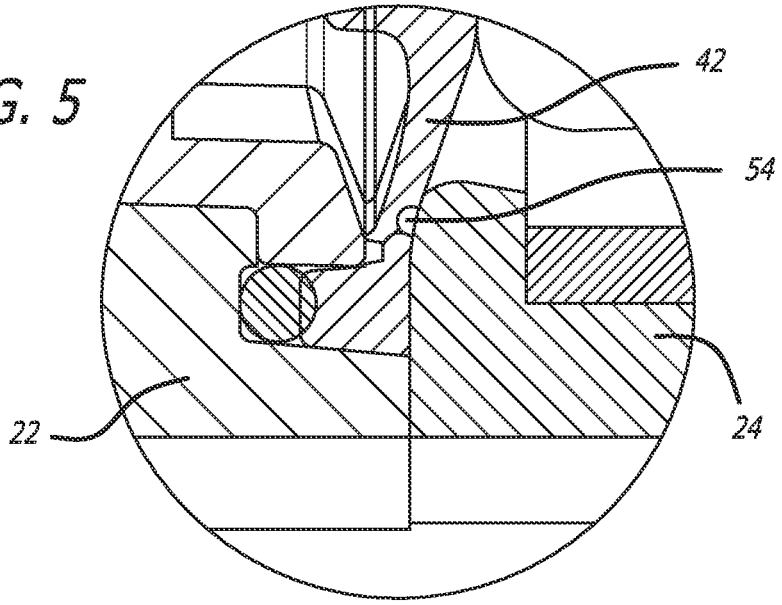
FIG. 5 is an enlarged cross-sectional view showing a diaphragm hinge.

As shown in FIG. 5, the diaphragm 42 may have thinned cross-sectional area 54 that creates a hinge. Without the hinge the diaphragm 42 expands in a manner resembling a bell curve. With the thinned hinge 54 the diaphragm 42 has more displacement at the diaphragm periphery. The result is an increase in volumetric displacement within the pump chambers 34 and greater overall pump output.

Referring again to FIG. 2, the pump 10 may include a pulsation damper 56 that absorbs pressure surges from the pump chambers 34. The pulsation damper 56 is located in-line with the outward flow of fluid and essentially 90 degrees relative to the outlet port so that any surge in pressure is initially applied to and absorbed by the damper 56 The pulsation damper 56 may be integrated into the pump housing 14 and include a diaphragm 58, a piston 60 and a spring 62. The pressure surge moves the diaphragm 58 and piston 60 which compress the spring 62 to store the energy created by a pressure surge. The pump 10 may also include a flexible liner 64 that is located in-line with the outward flow of pressure. The flexible liner 64 will compress and absorb energy created by pressure surges. Both the pulsation damper 56 and the flexible liner 64 reduce the noise of the pump 10.

Figure 6:
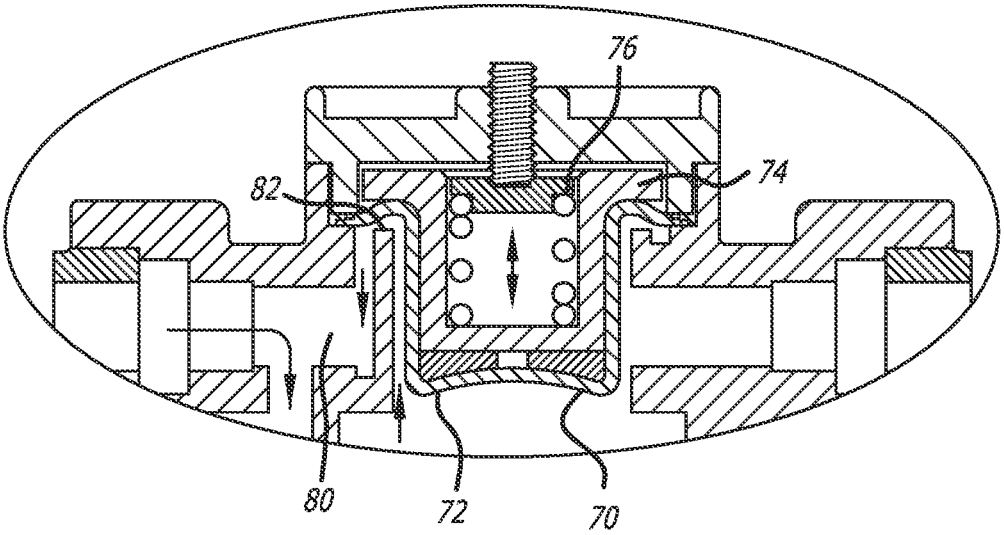
FIG. 6 is an enlarged cross-sectional view showing an alternate embodiment wherein a pulsation damper is integrated into a relief valve.

FIG. 6 shows an alternate embodiment wherein the pulsation damper is integrated into a relief valve. The integrated damper valve 70 may include a sleeve 72 that covers a piston 74. A spring 76 is located with the piston 74 and absorbs energy exerted by pressure surges. High pressures may cause the sleeve 72 to move away from a housing seat 78 such that fluid will flow back into an inlet chamber 80.

The pump 10 may have an elastomeric sleeve 66 adjacent to the wobble plate 44. The elastomeric sleeve 66 provides a seal to any fluid that leaks through the diaphragm 42. Thus if the diaphragm is to leak the leaked fluid is contained within the pump 10. The elastomeric nature of the sleeve 66 also absorbs energy and reduces the noise of the pump 10. The pump 10 may also have a relief valve 68 that is integrated into the pump housing 14. The relief valve 68 opens when the pump pressure exceeds a threshold value.

Figure 8:
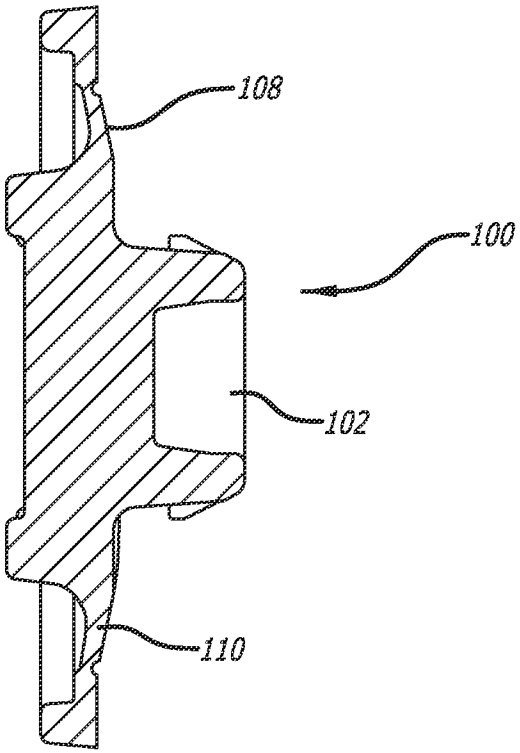
Figure 7:
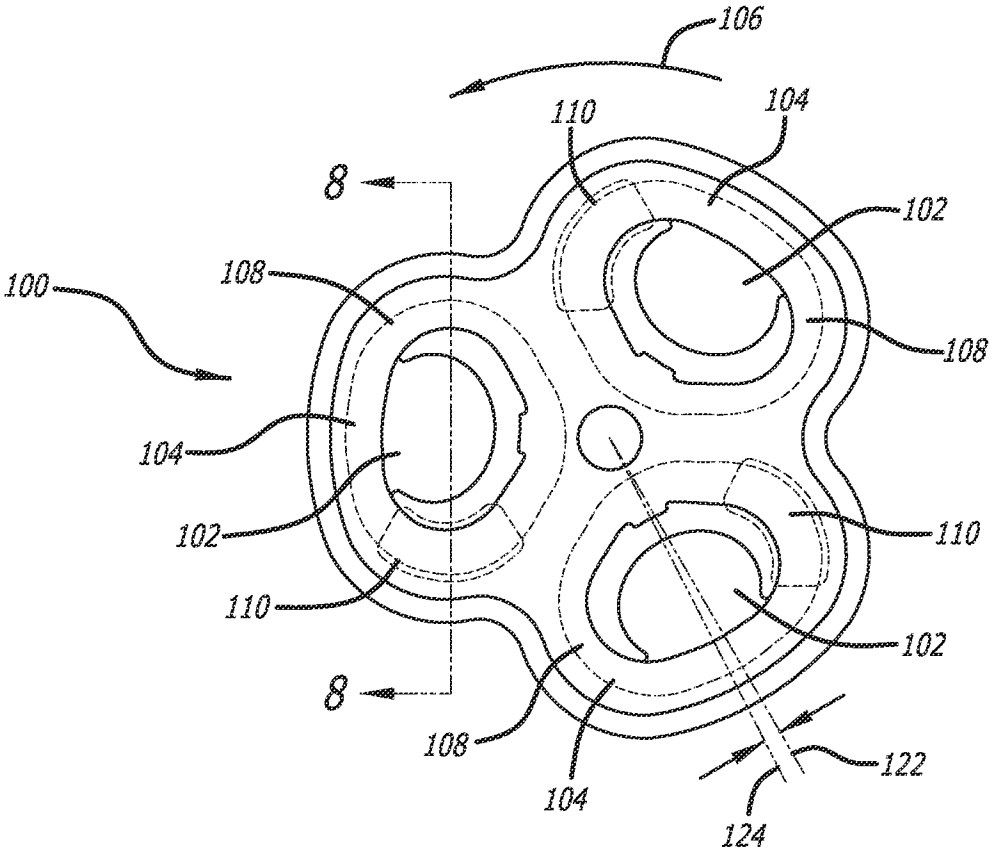
FIG. 7 is a perspective view of an alternate embodiment of a diaphragm; and, FIG. 8 is a cross-sectional view of the diaphragm shown in FIG. 7.

FIGS. 7 and 8 show an alternate embodiment of a diaphragm 100. The diaphragm 100 has a plurality of diaphragm piston openings 102. Each opening 102 is adjacent to a flex area 104 of the diaphragm 100. If the rotation of the pump motor is in a counterclockwise direction as indicated by the arrow 106 then each flex area 104 has a leading edge 108 and a trailing edge 110. When the wobble plate rotates, the leading edge 108 initially moves in an outward direction creating stress on both the leading and trailing edges. Continued wobble movement generates a piston force on the trailing edge 110 which results in the trailing edge having continuous high pressure and resulting stress. To increase the life of the diaphragm 100 the thickness of the trailing edge 108 has a thickness greater than the leading edge 110. Only the thickness of the trailing edge 108 is thickened as opposed to increasing the overall thickness of the diaphragm 100. Increasing the overall diaphragm thickness would increase the work requirements of the pump.

Referring to FIG. 2 each piston 40 is located within a wobble plate piston opening 120. Referring to FIG. 7 each wobble plate piston opening has a centerline 122 that extends through the center of the opening 120. The diaphragm 100 may have diaphragm piston openings 102 with centerlines 124 that are offset from the wobble plate piston openings centerlines 122 when the pump is not operating. When the pump is operating the pump motor causes counterclockwise rotation that generates a torque. The torque of the motor causes the diaphragm to shift such that the centerlines 122 and 124 are coaxial. This may reduce or eliminate unwanted contact and noise between the pistons and wobble plate.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A multi-chamber wobble plate pump, comprising:

a housing that has an inlet port, an outlet port and a plurality of pump chambers;

a plurality of inlet valves each located within one of said pump chambers to control fluid flow from said inlet port to said pump chambers, each inlet valve having an asymmetric cross-section with a thin section, each inlet valve including a stem with a longitudinal axis, said asymmetric cross-section being in a plane perpendicular to said longitudinal axis, said thin section having a mechanical strength that is less than a remaining portion of each inlet valve;

a plurality of outlet valves that control fluid flow from said pump chambers to said outlet port;

a plurality of pistons that move within said pump chambers;

a diaphragm attached to said plurality of pistons; and, a wobble plate coupled to said diaphragm to move said pistons within said pump chambers to cause fluid flow into and out of said pump chambers.

2. The multi-chamber wobble plate pump of claim 1, wherein said inlet and outlet valves each have a peripheral seal bead.

3. The multi-chamber wobble plate pump of claim 1, wherein said diaphragm includes a thin cross-sectional area that creates a hinge.

4. The multi-chamber wobble plate pump of claim 1, further comprising a pulsation damper located in-line with an outward flow of fluid and essentially at a right angle to said outlet port.

5. The multi-chamber wobble plate pump of claim 4, wherein said pulsation damper is integrated into said housing.

6. The multi-chamber wobble plate pump of claim 1, further comprising a relief valve integrated into said housing.

7. The multi-chamber wobble plate pump of claim 1, further comprising a flexible liner located with said housing in-line with an outward flow of fluid to absorb pressure surges within the fluid.

8. The multi-chamber wobble plate pump of claim 1, further comprising an elastomeric seal sleeve located within said housing adjacent to said wobble plate.

* * * * *